US006126520A

United States Patent [19]

Jochim-Schmidt et al.

[11] Patent Number: 6,126,520

[45] Date of Patent: Oct. 3, 2000

[54] FIXTURE AND METHODOLOGY FOR COUPLING AN OPTICAL COMPONENT TO A MACHINE

[75] Inventors: Hans Jochim-Schmidt; Shane Leicht, both of Midland, Canada

[73] Assignee: Raytheon Company, Lexington, Mass.

[21] Appl. No.: 08/727,808

[22] Filed: Oct. 7, 1996

[51] Int. Cl.[7] ..... B24B 1/00

[52] U.S. Cl. ..... 451/42; 451/388; 451/390

[58] Field of Search ..... 451/289, 286, 451/42, 388, 364, 41, 390; 29/559; 269/21, 275, 268

[56] References Cited

U.S. PATENT DOCUMENTS

| | | | |
|---|---|---|---|
| 2,444,531 | 7/1948 | Richardson | 451/388 |
| 2,542,101 | 2/1951 | Suben | 451/388 |
| 2,688,220 | 9/1954 | Boutell | 451/388 |
| 3,794,314 | 2/1974 | Coburn et al. | 451/390 |
| 3,962,833 | 6/1976 | Johnson | 451/42 |
| 3,971,170 | 7/1976 | Coburn et al. | 451/42 |
| 3,978,620 | 9/1976 | Feneberg et al. | 451/388 |
| 4,089,102 | 5/1978 | Soper et al. | 451/390 |
| 4,213,698 | 7/1980 | Firtion et al. | 451/388 |
| 4,562,671 | 1/1986 | Bouillon et al. | 451/388 |
| 4,597,228 | 7/1986 | Koyama et al. | 451/388 |
| 4,906,011 | 3/1990 | Hiyamizu et al. | 269/21 |
| 4,981,345 | 1/1991 | Berry et al. | 269/21 |
| 5,291,692 | 3/1994 | Takahashi et al. | 451/388 |
| 5,316,255 | 5/1994 | Marcusen | 269/21 |
| 5,417,408 | 5/1995 | Ueda | 269/21 |
| 5,421,595 | 6/1995 | Cripe et al. | 269/21 |

*Primary Examiner*—Timothy V. Eley
*Assistant Examiner*—Derris H. Banks
*Attorney, Agent, or Firm*—W. C. Schubert; G. H. Lenzen, Jr.

[57] ABSTRACT

The present invention provides a fixture (10) for coupling an optical component (12) to a machining apparatus through the use of a vacuum. The fixture includes a base (34) having means for coupling the fixture (10) to a machine and defining an aperture (50) communicable with a vacuum source, a fixture (60) sealably coupled to the base (34), and a pad (92) disposed on the fixture (60). The fixture (60) further includes an inner surface (64), an outer surface (66), and a passage (68) extending therebetween. The fixture is coupled to the base such that the inner surface (64) of the fixture (60) cooperates with the base (34) to define a cavity (62). The pad (92) is disposed on the fixture (60) to surround the passage (68) communicating with the cavity (62) and to securely and sealingly connect an optical component (12) to the fixture (60) when the cavity (62) is subjected to a negative pressure. The method disclosed and claimed herein for connecting an optical component (12) to a tooling machine includes the steps of coupling a tooling fixture assembly (10) to the tooling machine placing an optical component (12) on the tooling fixture assembly (10) such that the optical component (12) covers the passage (68,98) communicating with the cavity (62), and creating a negative pressure within the cavity (62) thereby urging the optical component (12) toward the cavity (62) and securing the optical component (12) to the fixture (10).

17 Claims, 2 Drawing Sheets

FIXTURE AND METHODOLOGY FOR COUPLING AN OPTICAL COMPONENT TO A MACHINE

BACKGROUND OF THE INVENTION

1. Technical Field

The present invention relates generally to a tooling apparatus for machining a blank and, more particularly, to a tooling fixture for releasably connecting an optical component to a tooling machine.

2. Discussion

Manufacturing optical components such as lenses requires milling, lapping, and polishing of a blank. At each of these stages an operator couples the optical component to a machine specifically designed to perform one of these operations. To expedite the manufacturing process, the optical component is commonly coupled to a fixture that is removably connectable to each of the machines. Commonly, the optical component is placed upon the fixture at the start of the manufacturing process and selectively connected to each of the particular tooling machines through a mechanical connection.

Traditionally, optical components have been connected to tooling fixtures through the use of adhesives or bonding agents such as lock-tight glues, ultraviolet adhesives, or molten pitch. While these products are generally adequate to prevent movement of the optical component relative to the fixture during manufacturing, their use presents disadvantages relating to the efficiency of manufacture as well as the quality of the resulting optical component. More particularly, bonding agents provide an adhesive connection that allows springing or deformation of the optical component from outside tool pressures that reduce the accuracy of the machining process and create undesirable optical surface irregularities. Further, bonding agents require relatively complex separation procedures that extend the time needed to release the component from the fixture while also tending to deform the optical component's surface during release. Complex separation procedures inhibit regular inspection during milling, lapping and polishing of the optical component while surface deformation again increases the probability of creating optical surface irregularities.

SUMMARY OF THE INVENTION

The present invention provides a fixture assembly for connecting an optical component to a machining apparatus through the use of a vacuum. The fixture assembly includes a base having means for connecting the fixture assembly to a machine and defining an aperture communicable with a vacuum source, a fixture sealably connected to the base, and a pad disposed on the fixture. The fixture further includes an inner surface, an outer surface, and a passage extending therebetween. The fixture is coupled to the base such that the inner surface of the fixture cooperates with the base to define a cavity. The pad is disposed on the fixture so as to surround the passage communicating with the cavity. The novel fixture assembly releasably yet uniformly secures an optical component to a tooling machine thereby simplifying inspection procedures and reducing optical surface irregularities.

The method disclosed and claimed herein for connecting an optical component to a tooling machine includes the steps of coupling a tooling fixture assembly to the tooling machine, placing an optical component on the tooling fixture assembly such that the optical component covers the passage communicating with the cavity, and creating a negative pressure within the cavity thereby urging the optical component toward the cavity and securing the optical component to the fixture.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

The following description of the preferred embodiment of the present invention is merely exemplary in nature and is not intended to limit the scope of the claimed invention. Moreover, while depicting the invention in an environment specifically relating to machining an optical component such as a lens, the following description is intended to adequately teach one skilled in the art to make and use the fixture assembly and method described herein to produce a variety of machined products. Specifically, those skilled in the art will appreciate that the tooling setup and fixture assembly described and claimed herein is applicable to many machining tasks wherein it is desirable to removably connect the work piece to the machine.

Figure 1:
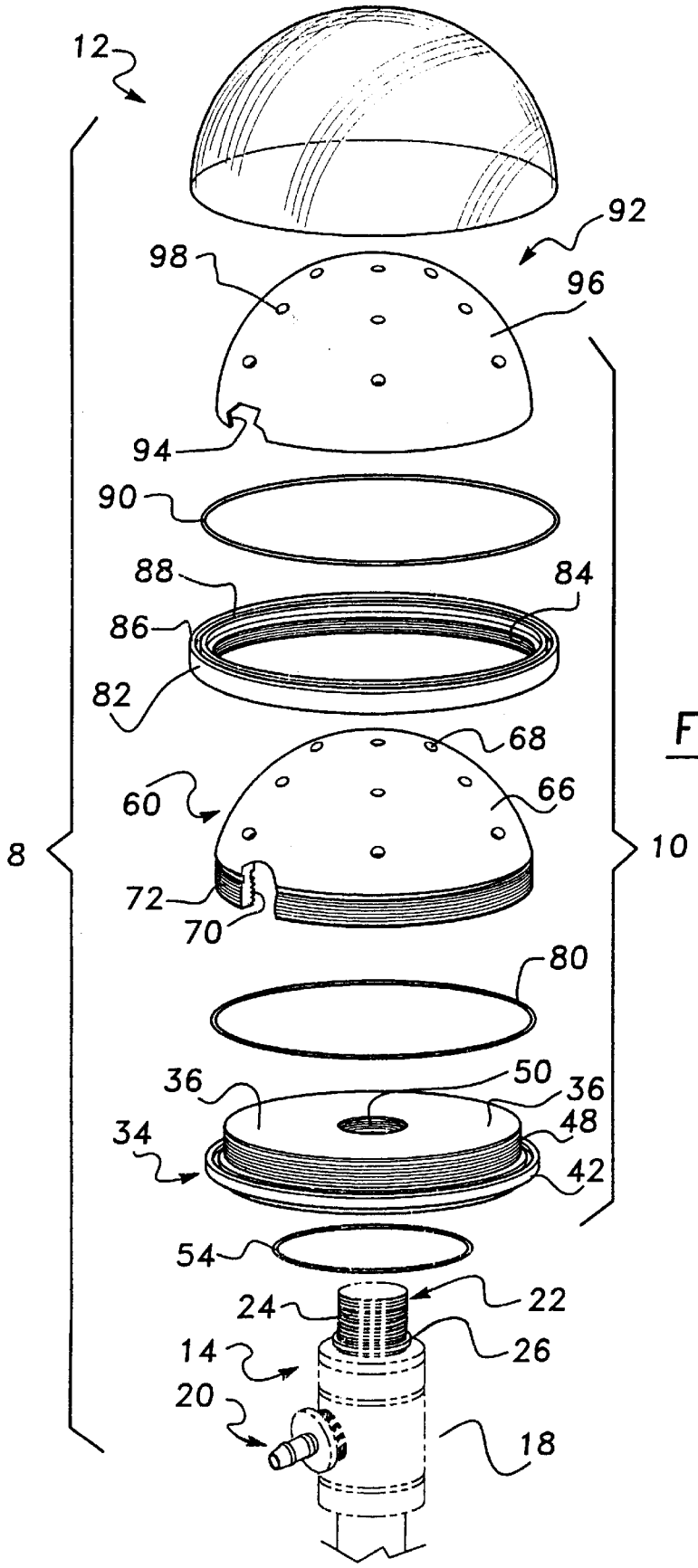
FIG. 1 is an exploded perspective view of a tooling setup according to the present invention.

As illustrated in FIG. 1 of the drawings, a tooling setup 8 includes a fixture assembly 10 configured to connect an optical component 12 to a vacuum adaptor 14. In a manner known in the art and as best illustrated in FIGS. 2 and 3, vacuum adaptor 14 is connectable for rotation with a tooling machine spindle 16.

Figure 2:
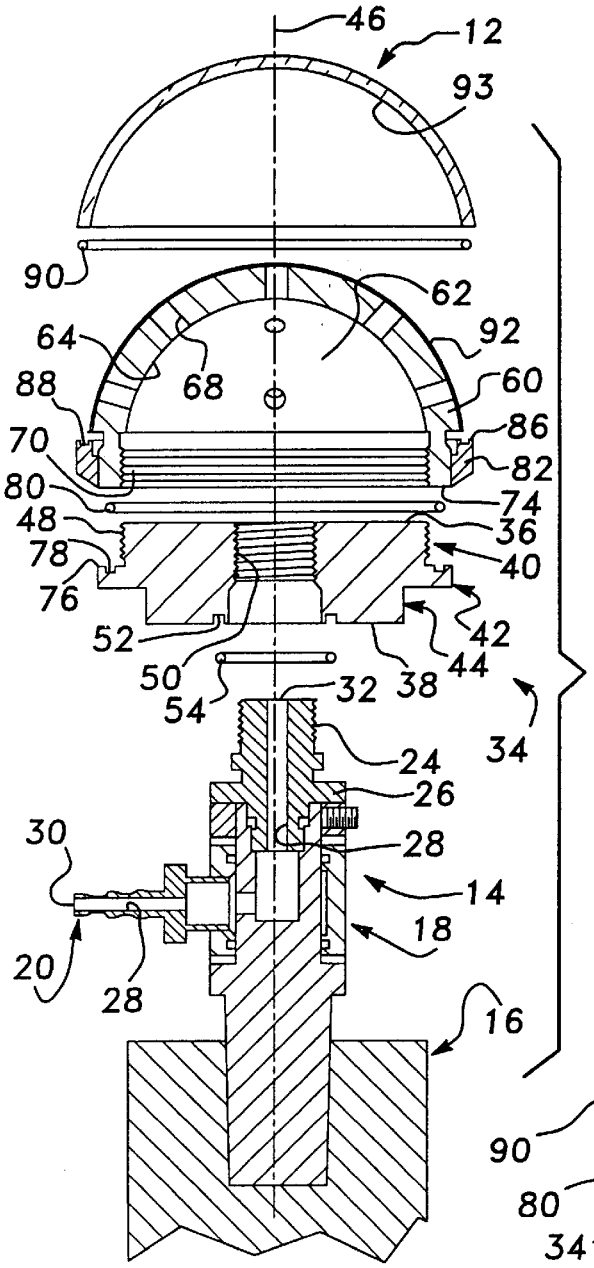
FIG. 2 is a partially exploded sectional view of the tooling setup shown in FIG. 1.
Figure 3:
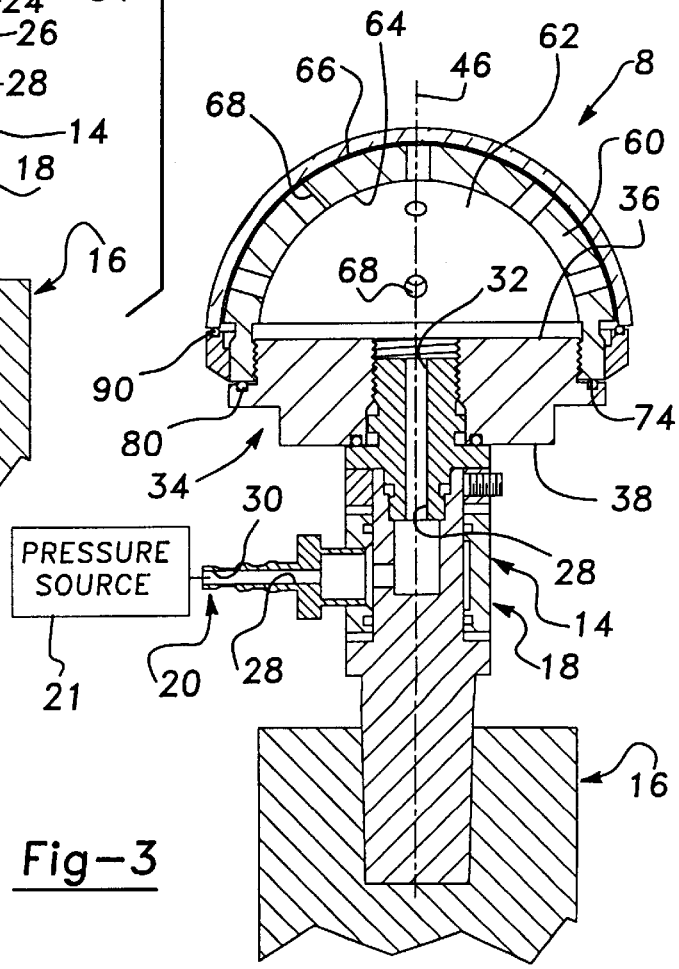
FIG. 3 is a sectional view of the tooling setup shown in FIG. 1 with the fixture assembly fully assembled to connect an optical component for rotation with a vacuum adapter and a spindle.

A specific embodiment of vacuum adaptor 14 is shown in FIG. 1 to include a trunk 18 adjoining a connector nipple 20 that is connectable to a vacuum source 21 (FIG. 3). Adaptor 14 further includes a mounting post 22 having an external thread 24 and adjoining trunk 18 to define an annular flange 26. With reference to FIG. 2, vacuum adaptor 14 further defines a passage 28 extending from a nipple inlet 30 to an adaptor outlet 32. Those skilled in the art will appreciate that fixture assembly 10 is adapted for connection to a variety of optical machines including milling, lapping, and/or polishing machines. Those skilled in the art will further appreciate that the machine defining spindle 16 may be adapted to generate a vacuum and to accommodate the direct connection of fixture assembly 10 thereto so as to eliminate the need for vacuum adaptor 14. It is specifically contemplated that vacuum adaptor 14 may be eliminated in the milling and lapping stages of the manufacture of optical component 12.

Fixture assembly 10 includes a base 34 preferably defining a generally planar upper annular surface 36 and a generally planar lower annular surface 38 (FIG. 2) interconnected by a first radial surface 40, an annular flange 42 and a second radial surface 44. Base 34 is preferably a disk-shaped member formed concentric about an axis 46 to include, as best seen in FIG. 1, external thread 48 on first radial surface 40 and a threaded cylindrical passage 50 centered about axis 46. As illustrated in the drawings, threaded cylindrical passage 50 and external thread 24 releasably couple base 34 to vacuum adaptor 14. A sealing groove 52 is preferably formed in base 34 to circumscribe threaded passage 50 adjacent lower annular surface 38 and to accommodate a sealing member such as O-ring 54. Accordingly, when base 34 is secured to adaptor 14, O-ring 54 is compressed within sealing groove 52 by flange 26 of vacuum adaptor 14 to provide a seal therebetween (FIG. 3). It should be appreciated that a variety of other sealing configurations known in the art may be used without departing from the scope of the invention as defined by the appended claims.

Fixture assembly 10 also includes a fixture 60 threadably connectable to base 34 to define a cavity 62 therebetween (FIG. 2). Cavity 62 is in fluid communication with vacuum adaptor passage 28 via threaded passage 50 thereby allowing an operator to control the pressures within cavity 62. Fixture 60 is preferably a dome-shaped shell formed of brass to define an inner surface 64, an outer surface 66, and a plurality of communication passageways 68 extending therebetween. As best illustrated in FIG. 1, fixture 60 further includes an internal thread 70 and an external thread 72 formed on inner and outer surfaces 64 and 66, respectively, and each extending from a radial end face 74 of fixture 60 (FIGS. 2 and 3). Internal thread 70 is configured to cooperate with external thread 48 formed on first radial surface 40 of base 34 to removably connect fixture 60 to base 34. Further, annular flange 42 of base 34 preferably includes an annular face 76 having a sealing groove 78 formed therein to accommodate a second O-ring 80. As best seen in FIG. 3, radial end face 74 of fixture 60 compresses second O-ring 80 to create a seal when fixture 60 is connected to base 34.

An adjustable clamping ring 82 includes an internal thread 84 cooperative with external thread 72 formed on fixture 60 to removably connect adjustable clamping ring 82 thereto. Clamping ring 82 defines an upper annular face 86 having a sealing groove 88 accommodating a third O-ring 90. The threaded connection provided by threads 84 and 72 allows the position of upper annular face 86 relative to radial end face 74 to be adjusted by rotating ring 82 relative to fixture 60. As a result, fixture assembly 10 can be positioned to accommodate optical components of varying sizes.

Optical component 12 is positionable upon fixture assembly 10 so as to rest upon pad 92. Fixture 60 is preferably formed such that outer surface 66 defines a radius equal to the radius of an inner surface 94 of optical component 12. However, pad 92 is formed of a flexible material having sufficient tensile strength to accommodate slight radius differences commonly resulting from manufacturing tolerances. From the above description and the appended drawings, those skilled in the art should appreciate that a negative pressure provided in cavity 62 is communicated to inner surface 94 of optical component 12 to urge optical component 12 toward cavity 62. The resulting forces generated between fixture 60, pad 92, and optical component 12 tend to fix optical component 12 for rotation with fixture 60.

The composition of pad 92 is selected to releasably secure component 12 to fixture 60 while providing flexibility with respect to the sizes and configurations of optical components connectable to fixture assembly 10. More particularly, inner and outer surfaces 94 and 96, respectively, of pad 92 (FIG. 1) have a surface roughness sufficient to prevent movement of optical component relative to fixture 60 when cavity 62 is subjected to a selected vacuum pressure. In certain embodiments of the present invention, it may be desirable to form inner surface 94 of pad 92 using a substance that tends to adhere to fixture 60 when compressed, such as an epoxy or polyurethane impregnated material, thereby securely coupling pad 92 to fixture 60 while also preventing pressure leakage across the interface between pad 92 and fixture 60. Additionally, pad 92 is selected such that the tensile strength thereof allows for slight radius differences between component 12 and outer surface 96 of fixture 60 while preventing the springing and deformation of optical component 12 that commonly results from tool pressures in systems using an adhesive to secure the optical component to a tooling machine.

Securement pad 92 is illustrated in FIGS. 1 and 2 to include openings 98 located to cooperate with passages 68 formed in fixture 60. Those skilled in the art will appreciate that openings 98 may be eliminated by forming pad 92 with a material having sufficient permeability to adequately communicate pressure from cavity 62 to optical component 12. The outer surface 96 of pad 92 is preferably formed of a velvet-like material that does not tend to scratch or mar the optical component during operation of fixture assembly 10. Pad 92 is further selected such that the outer surface 96 thereof provides minimal resistance to the removal of optical component 12 from pad 92 upon elimination of negative pressure in cavity 62. It is contemplated that the release of component 12 may be hastened by subjecting cavity 62 to a positive pressure through passage 28 thereby urging component 12 therefrom.

It has been found that a policor polishing foil manufactured by LOH Optic Service of Wetzlar, Germany is particularly applicable for use as pad 92. However, from this description and a review of the preferred policor polishing foil, those skilled in the art will appreciate that a variety of equivalent materials may be used without departing from the scope of the invention as defined by the appended claims.

In addition to the novel tooling apparatus and fixture assembly disclosed and claimed herein, a corresponding method for connecting an optical component to a machine is disclosed and claimed. Specifically, performance of the novel method includes coupling fixture assembly 10 to a machine, locating optical component 12 on pad 92, and subjecting cavity 62 to a negative pressure to urge optical component 12 radially toward cavity 62 and secure optical component 12 to fixture 60.

The above description viewed in combination with the appended drawings and claims illustrate that the novel fixture assembly and methodology for machining an optical component simplifies inspection procedures and reduces optical surface irregularities common in prior art connection techniques. More particularly, the present invention allows the optical component to be held tightly and uniformly with a vacuum thereby eliminating the use of adhesives and the undesirable springing or deformation caused by tool pressures commonly associated with bonding agents. Further, the present invention provides simplified release procedures that more efficiently allow for inspection of the height, thickness, and surface form of the optical component at virtually any time during machining. The present invention is particularly applicable for use in sapphire dome production wherein the measured optical surface error is on the order of less than one fringe irregularity and wedge error is reduced to a value less than approximately 0.025 mm.

Various other advantages of the present invention will become apparent to those skilled in the art after having the benefit of studying the foregoing text and drawings, taken in conjunction with the following claims.

What is claimed is:

1. A fixture assembly for coupling an optical component to a machining apparatus, said fixture assembly comprising:

a base having means for coupling the fixture assembly to a machine and defining an aperture communicable with a vacuum source;

a fixture sealably coupled to said base, said fixture including an inner surface and an outer surface, said inner surface cooperating with said base to define a vacuum cavity therebetween, said fixture further including a passage extending between said inner and outer surfaces; and a pad disposed on said fixture and surrounding said passage, said pad having a compressible first surface for adhering said pad to said outer surface of said fixture and a velvet-like second surface for releasably securing said pad to said optical component.

2. The fixture assembly of claim 1 wherein said pad includes a second material coupled to a first material, said first material defining said first surface, said second material defining said second surface.

3. The fixture assembly of claim 1 wherein said fixture includes a first thread on said inner surface of the fixture and wherein said base defines a first radial surface having a thread cooperative with said first thread of said fixture to removably couple said fixture to said base.

4. The fixture assembly of claim 1 further including a clamping ring coupled to said fixture for movement between an upper position and a lower position.

5. The fixture assembly of claim 4 wherein said fixture includes a second thread on said outer surface of said fixture and wherein said clamping ring defines an inner threaded radial surface cooperative with said second thread of said fixture for movably coupling said clamping ring to said fixture.

6. The fixture assembly of claim 4 wherein said clamping ring includes an annular face defining a groove, said fixture assembly further including a sealing member disposable in said groove.

7. The fixture assembly of claim 1 wherein said base is a disk formed about an axis to include an outer radial surface, said base further including an annular flange projecting from said radial surface, said flange defining an annular face having a first groove, said fixture assembly further including a first sealing member disposable in said first groove for engagement with said fixture when said fixture is secured to said base.

8. The fixture assembly of claim 7 wherein said aperture is centered about said axis, said base having an internal thread surrounding said aperture to define said means for connecting the fixture assembly to a machine.

9. The fixture assembly of claim 8 wherein said base further includes a second groove, said fixture assembly including a second sealing member disposable in said second groove for engagement with a machining apparatus.

10. A tooling setup for manufacturing an optical component, said tooling setup comprising:

a tooling machine including vacuum means for generating a negative pressure, a pressure communicating passage hydraulically connected to said pressure means, and receiving means for coupling a fixture assembly to said machine;

a fixture assembly including a base, a fixture, and a pad, said base having coupling means cooperative with said receiving means for coupling said fixture assembly to said tooling machine, said base defining an aperture communicating with said pressure communicating passage, said fixture sealably connected to said base and including an inner surface and an outer surface, said inner surface cooperating with said base to define a cavity therebetween, said fixture further including a passage extending between said inner and outer surfaces, and said pad disposed on said fixture and surrounding said passage, said pad having an opening communicating with said passage;

an optical component contacting said pad and covering said opening whereby a negative pressure generated by said pressure means and communicated to said cavity through said passage urges the optical component toward said pad to secure said optical component to said fixture assembly; and a clamping ring movably coupled to said fixture for adjustment of said optical component between an upper position and a lower position relative to said fixture.

11. The tooling setup of claim 10 wherein said fixture defines a free end and a first thread on said inner surface proximal to said free end and wherein said base defines a first radial surface having a thread cooperative with said first thread of said fixture for removably coupling said fixture to said base.

12. The tooling setup of claim 11 wherein said fixture further includes a second thread on said outer surface of said fixture proximal to said free end thereof and wherein said clamping ring defines an inner threaded radial surface cooperative with said second thread of said fixture for movably coupling said clamping ring to said fixture.

13. The tooling setup of claim 10 wherein said aperture in said base is a threaded aperture defining said coupling means.

14. The tooling setup of claim 13 wherein said tooling machine includes an adaptor defining said pressure communicating passage and having an externally threaded post defining said receiving means, said threaded post cooperative with said threaded aperture to releasably secure said base to said adaptor.

15. A method for connecting an optical component to a tooling machine, said method comprising the steps of:

coupling a fixture assembly to a tooling machine, said fixture assembly defining a cavity, a passage communicating with said cavity, and a compliant pad adhesively secured about said passage and defining an opening communicating with said passage;

placing an optical component on said fixture assembly in surface contact with said compliant pad, said optical component covering said opening and being only frictionally secured to said pad;

adjusting the spacing between said fixture assembly and an edge of said optical component to thereby accommodate optical components of different sizes; and creating a negative pressure within said cavity to urge said optical component toward said cavity to thereby couple said optical component to said fixture assembly.

16. The method of claim 15 wherein said fixture assembly includes a base, a fixture, and a pad and wherein the step of coupling said fixture assembly to the tooling machine includes coupling said base to the tooling machine, sealably connecting said fixture to said base to define said cavity therebetween, and disposing said pad on said fixture.

17. The method of claim 15 further comprising the step of:

thereafter creating a positive pressure within said cavity to urge said optical component away from said cavity and thereby uncouple said optical component from said fixture assembly.

* * * * *